US011833572B2

(12) United States Patent
Fiorentini et al.

(10) Patent No.: US 11,833,572 B2
(45) Date of Patent: Dec. 5, 2023

(54) BENDER FOR BENDING A WORKPIECE WITH AUTOMATIC SPRINGBACK COMPENSATION

(71) Applicant: Greenlee Tools, Inc., Rockford, IL (US)

(72) Inventors: Henry Alexander Fiorentini, Rockford, IL (US); Anthony J. Bussan, Davis Junction, IL (US); Andrew Francis Troy, Chicago, IL (US); SatishKumar SivaSankaran, Rockford, IL (US); Thomas M. Sticha, Rockford, IL (US); John Russell Fenske, Loves Park, IL (US); Joshua Curtis Kerns, Rockford, IL (US)

(73) Assignee: GREENLEE TOOLS, INC., Rockford, IL (US)

( * ) Notice: Subject to any disclaimer, the term of this patent is extended or adjusted under 35 U.S.C. 154(b) by 0 days.

(21) Appl. No.: 17/193,033

(22) Filed: Mar. 5, 2021

(65) Prior Publication Data

US 2021/0276064 A1 Sep. 9, 2021

Related U.S. Application Data

(60) Provisional application No. 62/986,053, filed on Mar. 6, 2020.

(51) Int. Cl.
*B21D 7/025* (2006.01)
*B21D 7/14* (2006.01)

(52) U.S. Cl.
CPC ..... *B21D 7/025* (2013.01); *B21D 7/14* (2013.01)

(58) Field of Classification Search
CPC ..... B21D 7/02; B21D 7/022; B21D 7/024; B21D 7/025; B21D 7/04; B21D 7/08; B21D 7/085; B21D 7/12; B21D 7/14
See application file for complete search history.

(56) References Cited

U.S. PATENT DOCUMENTS 3,060,587 A 10/1962 Picken
3,949,584 A * 4/1976 Pearson ..... B21D 7/024 72/157

(Continued)

FOREIGN PATENT DOCUMENTS

DE 102011006101 A1 * 9/2012 ..... B21D 7/024
WO WO-2018202612 A1 * 11/2018 ..... B21D 7/024

OTHER PUBLICATIONS

Translation of DE 10 2011 006 101 A1, Juergen Wolf, 2012 (Year: 2012).*

(Continued)

*Primary Examiner* — Debra M Sullivan
*Assistant Examiner* — Matthew Stephens
(74) *Attorney, Agent, or Firm* — Klintworth & Rozenblat IP LLP

(57) ABSTRACT

A bender configured to bend a workpiece in a bending operation and its method of use are provided. The bender includes a frame, a bending shoe assembly rotatably mounted on the frame, a control system and a driver in communication therewith, and a springback assembly in communication with the control system and configured to provide information to the control system regarding information on a bend affected to the workpiece. The bending shoe assembly includes a bending shoe into which the workpiece can be seated, and a gripping member mounted on the bending shoe and configured to grip the workpiece during the bending operation. The driver provides rotational force to the bending shoe assembly to rotate the bending shoe assembly relative to the frame.

20 Claims, 12 Drawing Sheets

(56) References Cited

U.S. PATENT DOCUMENTS

| | | | | |
|---|---|---|---|---|
| 4,394,799 | A | 7/1983 | Moree et al. | |
| 5,050,089 | A * | 9/1991 | Stelson | B21D 7/14 702/41 |
| 5,144,823 | A | 9/1992 | Wood | |
| 5,167,075 | A | 12/1992 | Weldy et al. | |
| 5,275,031 | A * | 1/1994 | Whiteside | B21D 7/14 72/149 |
| 5,290,166 | A | 3/1994 | Heatherly | |
| 5,531,031 | A | 7/1996 | Green | |
| 5,669,258 | A | 9/1997 | Luebke | |
| 6,253,595 | B1 * | 7/2001 | Lewis | B21D 9/00 72/369 |
| 6,385,856 | B1 | 5/2002 | Godin | |
| 6,980,880 | B1 * | 12/2005 | Ramsey | B21D 7/14 700/165 |
| 8,661,701 | B2 | 3/2014 | Wixey et al. | |
| 9,283,605 | B2 | 3/2016 | Plummer et al. | |
| 9,375,773 | B2 | 6/2016 | Plummer et al. | |
| 9,663,304 | B2 | 5/2017 | Mantell et al. | |
| 9,849,494 | B2 | 12/2017 | Plummer et al. | |
| 10,011,007 | B2 | 7/2018 | Velez | |
| 10,217,237 | B1 * | 2/2019 | Goncharov | G06T 7/62 72/157 |
| 10,478,881 | B2 | 11/2019 | Plummer et al. | |
| 10,569,320 | B2 | 2/2020 | Nobles | |
| 2009/0178453 | A1 * | 7/2009 | Ghiran | B21C 51/00 72/31.05 |
| 2013/0319061 | A1 | 12/2013 | Tofini | |
| 2015/0135793 | A1 | 5/2015 | Plummer et al. | |
| 2016/0325940 | A1 * | 11/2016 | Rimmington | B65G 43/00 72/157 |
| 2016/0354823 | A1 * | 12/2016 | Nozu | B21D 9/03 72/157 |
| 2017/0095849 | A1 * | 4/2017 | Nobles | B21D 7/14 72/157 |
| 2017/0095850 | A1 * | 4/2017 | McNurlin | B21D 7/00 72/157 |
| 2020/0070230 | A1 | 3/2020 | Plummer et al. | |
| 2021/0063134 | A1 | 3/2021 | Scioscia, Jr. | |

OTHER PUBLICATIONS

International Search Report for corresponding International Patent Application No. PCT/US2021/021080 dated May 26, 2021, 2 pages.
Written Opinion for corresponding International Patent Application No. PCT/US2021/021080 dated May 26, 2021, 2 pages.
"Instruction Manual, Greenlee, 855GX IntelliBENDER® Electric Bender," 2019.
Kapro 393 DIGI PRO; https://kapro.com/wp-content/uploads/2019/03/393-DIGI-PRO-.pdf, 2018.
Klein 935 Digital Angle Gauge and Level; https://www.kleintools.com/catalog/level-measuring-tools/digital-angle-gauge-and-level, Sep. 2019.
Sumner* Universal Center Punch; https://www.sumner.com/sumner/sub/productb/main.322.7.11.322.0.0.html, Mar. 25, 2012.
https://www.magnet4sale.com/8-sets-of-strong-neodymium-channel-magnets-w-countersunk-holes-45-lb-holding-power-each-matching-screws-included/, Dec. 21, 2017.
Active Angle Control (0:18 sec, 0:23 sec, 0:30 sec, 0:34 sec, 0:35 sec, 0:36 sec, 0:40 sec, 0:42 sec, 0:45 sec, 0:51 sec, 0:53 sec, 0:58 sec, 0:59 sec, 1:00 min, 1:01 min, 1:02 min), Youtube.com, https://youtu.be/AMfEc-DsLt4?t=22 Dec. 8, 2016, 16 pages.
"Instruction Manual 854DX Electric Bender," Greenlee Textron, Inc., Rockford IL, USA, 2015, 32 pages.
"Instruction Manual 881 and 881CT Cam Track Hydraulic Benders and 1813 Bending Table," Greenlee Textron, Inc., Rockford IL, USA, 2011, 104 pages.

* cited by examiner

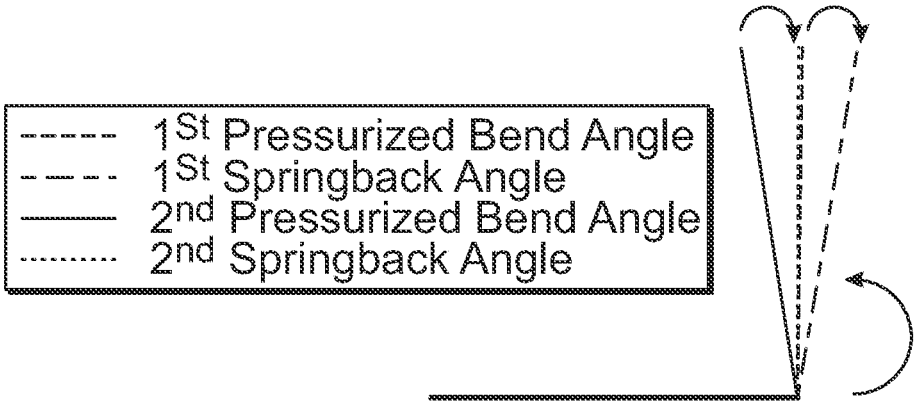
FIG. 6
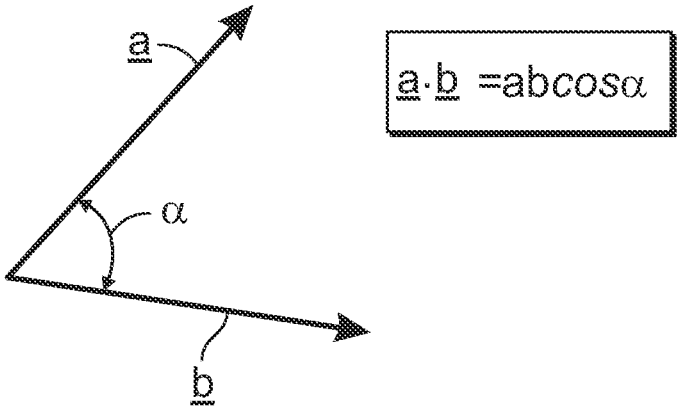
FIG. 7
$$\text{atan2}(y,x) = \begin{cases} \arctan\left(\frac{y}{x}\right) & \text{if } x > 0, \\ \arctan\left(\frac{y}{x}\right) + \pi & \text{if } x < 0 \text{ and } y \geq 0, \\ \arctan\left(\frac{y}{x}\right) - \pi & \text{if } x < 0 \text{ and } y < 0, \\ +\frac{\pi}{2} & \text{if } x = 0 \text{ and } y > 0, \\ -\frac{\pi}{2} & \text{if } x = 0 \text{ and } y < 0, \\ \text{undefind} & \text{if } x = 0 \text{ and } y = 0. \end{cases}$$
FIG. 8

BENDER FOR BENDING A WORKPIECE WITH AUTOMATIC SPRINGBACK COMPENSATION

CROSS-REFERENCE TO RELATED APPLICATION(S)

This application claims priority to U.S. provisional application Ser. No. 62/986,053, filed on Mar. 6, 2020, the contents of which is incorporated herein in its entirety.

FIELD OF THE DISCLOSURE

The present disclosure generally relates to a bender for automatically bending workpiece to a target bend angle.

BACKGROUND

Benders for bending different types and sizes of workpieces have been utilized for many years. Many of these benders include a generally-circular shaped shoe having a groove which receives a workpiece. A gripping member, often called a saddle or a hook, is provided at a leading end of the groove and grips the workpiece. As the bending shoe is rotated, the workpiece is wrapped around the bending shoe to desired degree.

In order for the operator to bend a workpiece to a desired angle, the operator must know certain characteristics of the workpiece and utilizing the above criteria, the operator determines the necessary bending operation to achieve the target bend angle in the workpiece. When a metal workpiece is bent, the operator must account for "springback", which is the tendency for workpiece to "unbend" slightly once the workpiece is unloaded from the bending shoe. The amount of springback depends on the workpiece size, type, and the bend angle. In addition, environmental differences such as temperature may make the same piece of workpiece springback differently one day versus the next. The springback makes it difficult to create specific, accurate bend angles. To assist in making the proper bend operation, look-up tables are utilized. These look-up tables list average amounts of springback for each conduit type in each bending groove for a specific bender. Proper selection and use of the look-up tables are critical in order to obtain the proper bend instructions.

The process of using look-up tables and setting dials and/or switches prior to bending requires time consuming steps and are subject to operator error. Often one or more parameters is overlooked or set incorrectly, resulting in bending mistakes and thus wasting materials and time. In addition, consistent results are not always achieved because the amount of springback that the workpiece has depends on many factors, and even workpieces from the same production batch can have significantly different springback values.

If the process of using look-up tables and setting dials and/or switches prior to bending is not utilized and workpiece springback is to be accounted for by the operator, the operator typically needs to manually measure the amount of springback by placing an angle gauge on the workpiece and measuring the difference between a first position of the workpiece and a springback position of the workpiece, and then adding that amount to the original target. This is also time consuming to perform, and tends to create scrap metal.

SUMMARY

In an aspect of the disclosure, a bender is configured to bend a workpiece in a bending operation. A portion of the workpiece which is to be bent is straight prior to bending by the bender. The bender includes a frame, a bending shoe assembly rotatably mounted on the frame, a control system, a driver in communication with the control system and configured to provide rotational force to the bending shoe assembly to rotate the bending shoe assembly relative to the frame, and a springback assembly in communication with the control system and configured to provide information to the control system regarding information on a bend affected to the workpiece. The bending shoe assembly includes a bending shoe having a groove therein into which the workpiece can be seated during the bending operation and a gripping member mounted on the bending shoe and configured to grip the workpiece during the bending operation.

In an aspect of the disclosure, a bender configured to bend a workpiece in a bending operation, the workpiece having a straight axis straight prior to any bending. The bender includes a frame, a bending shoe assembly rotatably mounted on the frame, the bending shoe assembly including a bending shoe having a groove therein into which the workpiece can be seated during the bending operation and a gripping member mounted on the bending shoe and configured to grip the workpiece during the bending operation, a control system including a processor, a user interface coupled to the control system, a driver in communication with the control system and configured to provide rotational force to the bending shoe assembly to rotate the bending shoe assembly relative to the frame, and a sensor in communication with the control system, the sensor providing information regarding rotational positions of the workpiece around the workpiece axis.

In an aspect of the disclosure, a bender is configured to bend a workpiece in a bending operation. A portion of the workpiece which is to be bent is straight prior to bending by the bender. The bender includes a frame, a bending shoe assembly rotatably mounted on the frame, a control system, a driver in communication with the control system and configured to provide rotational force to the bending shoe assembly to rotate the bending shoe assembly relative to the frame, and a sensor in communication with the control system, the sensor providing information regarding rotational positions of the workpiece around the workpiece axis. The bending shoe assembly includes a bending shoe having a groove therein into which the workpiece can be seated during the bending operation and a gripping member mounted on the bending shoe and configured to grip the workpiece during the bending operation.

In an aspect of the disclosure, a method of operating a bender which is configured to bend a workpiece in a bending operation is provided. A portion of the workpiece which is to be bent is straight prior to bending by the bender. The method includes bending a workpiece to a target bend angle of between 0 degrees and 95 degrees around a bending shoe by rotating the bending shoe in a first direction, wherein the workpiece gripped by a gripping member on the bending shoe, stopping the rotation of the bending shoe when the target bend angle is reached, rotating the bending shoe in a second direction which is opposite to the first direction, wherein the workpiece is continued to be gripped by the gripping member, measuring a bend angle at which the workpiece is bent after the workpiece springs back, calculating a new bend angle at which the workpiece is to be bent, and bending the workpiece to the new bend angle around a bending shoe by rotating the bending shoe in the first direction, wherein the workpiece gripped by a gripping member on the bending shoe.

In an aspect of the disclosure, a method is provided. The method includes rotating a workpiece around workpiece axis, and measuring a rotational position of the workpiece as the workpiece is being rotating using a sensor.

In an aspect of the disclosure, a control system is configured to operate a bender to bend a workpiece in a bending operation. A portion of the workpiece which is to be bent is straight prior to bending by the bender. The control system includes a processor and a memory, wherein the processor is configured to carry out the steps of: commanding a bending shoe to rotate in a first direction to bend a workpiece gripped by a gripping member on the bending shoe to a target bend angle of between 0 degrees and 95 degrees around the bending shoe, commanding the bending shoe to stop rotation of the bending shoe when the target bend angle is reached, commanding the bending shoe and the gripping member to rotate in a second direction which is opposite to the first direction, determining a bend angle at which the workpiece is bent after the workpiece springs back, calculating a new bend angle at which the workpiece is to be bent, and commanding the bending shoe and the gripping member to rotate in the first direction to bend the workpiece to the new bend angle.

BRIEF DESCRIPTION OF THE FIGURES

FIG. 6 depicts a graphical representation of springback;

FIG. 7 depicts the law of cosines;

FIG. 8 depicts the a tan 2 formula;

DETAILED DESCRIPTION

Figure 1:
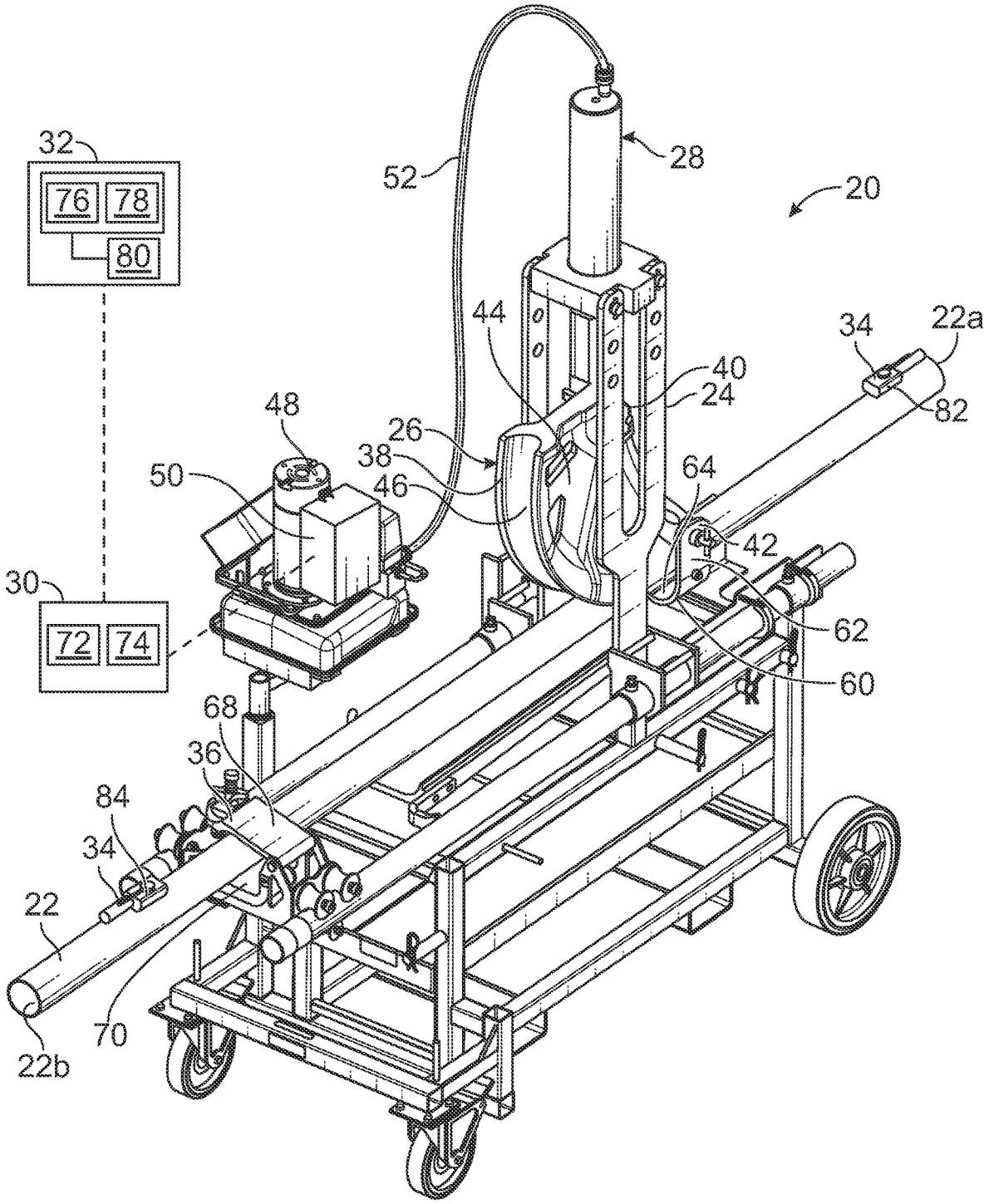
FIG. 1 depicts a perspective view of an example bender which incorporates features of the present disclosure, and showing a workpiece mounted therein prior to a bending operation.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

A bender 20, 120 is provided for automatically bending a workpiece 22 to form a bend at a target bend angle during a bending operation. The bender 20, 120 automatically accounts for springback of the workpiece 22 during the bending operation and allows the bend in the workpiece 22 to be accurately formed. This bender 20, 120 solves the problem of inconsistent springback while bending the workpiece 22, and the bender 20, 120 achieves tighter bend angle tolerances than conventional, fixed-amount springback adjustments. The bender 20, 120 automatically determines, and compensates for, the unique springback of each unique piece of workpiece 22.

In general, the bender 20, 120 performs a workpiece bending operation and includes a frame 24, 124, a bending shoe assembly 26, 126 rotatably mounted on the frame 24, 124, a driver 28, 128 for providing rotational force to the bending shoe assembly 26, 126, a control system 30, 130 for controlling operation of the driver 28, 128, a control device 32, 132 in communication with the control system 30, 130, and a springback assembly 34, 134 in communication with the control system 30, 130. The springback assembly 34, 134 provides information to the control system 30, 130 regarding angles at which the workpiece 22 is bent during the bending operation. A workpiece support assembly 36, 136 is also mounted to the frame 24, 124.

Figure 2:
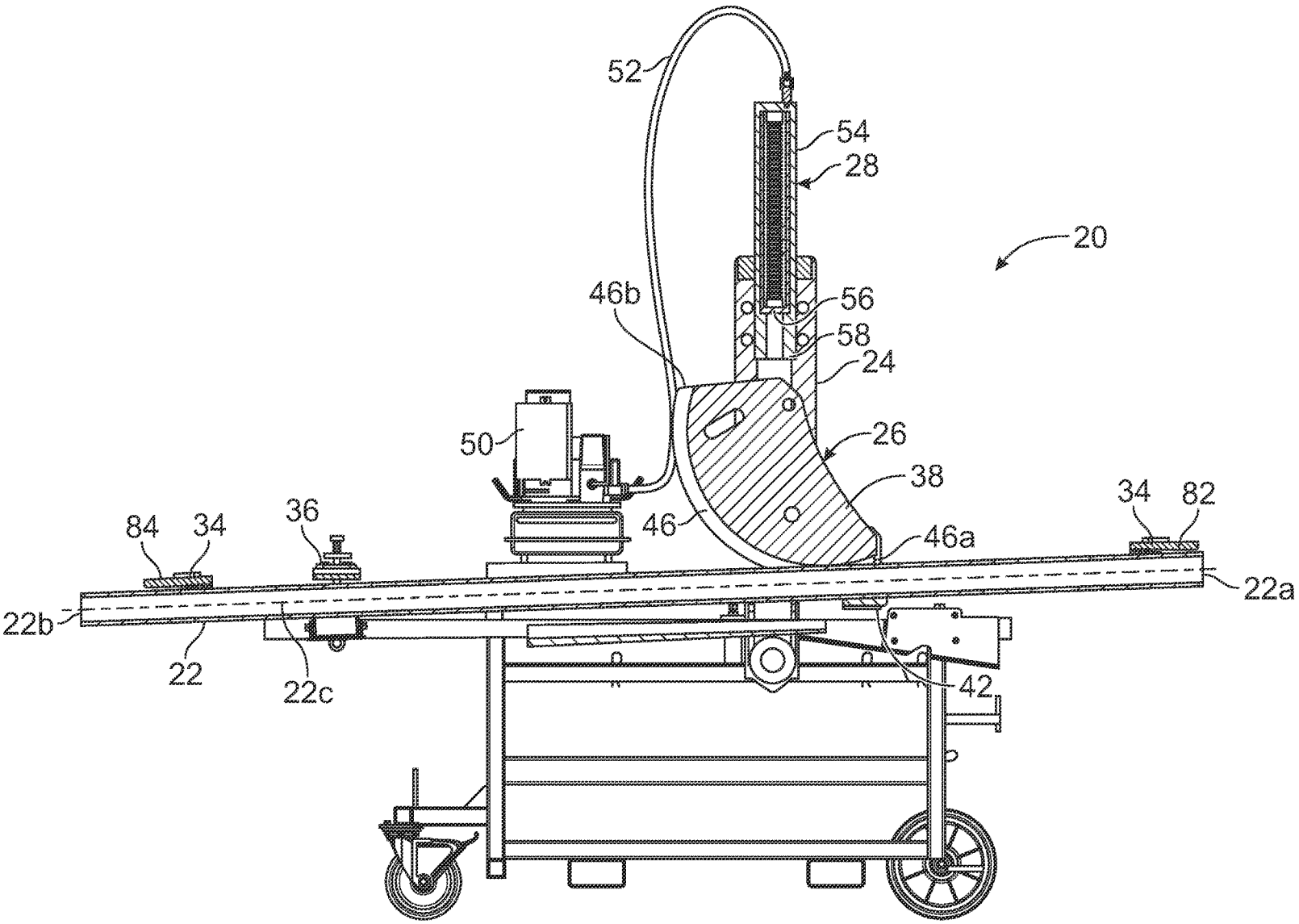
FIG. 2 depicts a cross-sectional view of the bender and the workpiece mounted therein prior to a bending operation.
Figure 10:
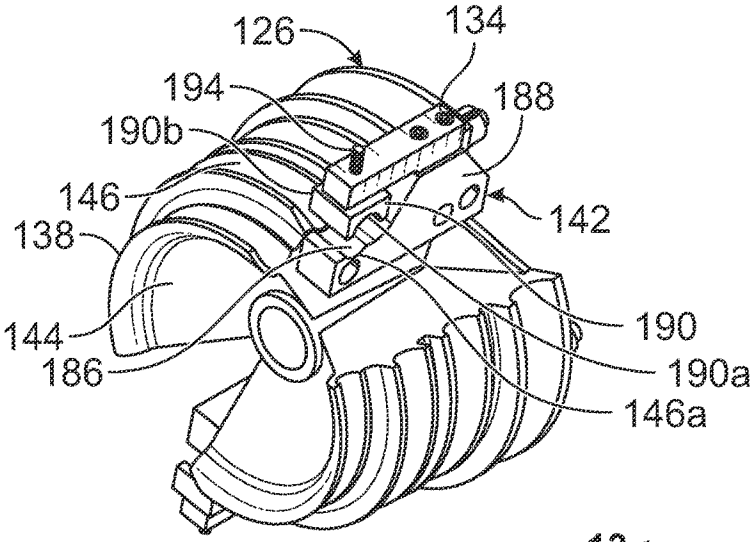
FIG. 10 depicts a perspective view of a bending shoe and a gripping member of the bender of FIG. 9.
Figure 12:
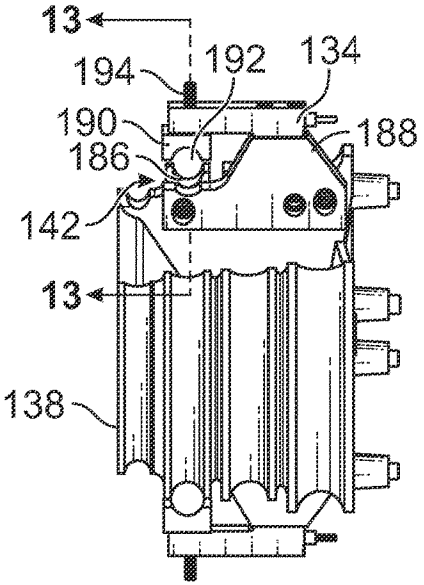
FIG. 12 depicts a front elevation view of the bending shoe and gripping member of FIG. 10.

The bending shoe assembly 26, 126 includes a bending shoe 38, 138, a shaft 40, 140 on which the bending shoe 38, 138 is mounted for rotation relative to the frame 24, 124, and a gripping member 42, 142, commonly called a saddle or a hook, attached to the bending shoe 38, 138. The bending shoe 38, 138 is formed from a body 44, 144 having an arc shaped groove 46, 146 in a surface thereof. As shown in FIGS. 2 and 10, the arc shaped groove 46, 146 has a leading end 46*a*, 146*a* and an opposite trailing end 46*b*, 146*b*. The groove 46, 146 may be semi-circular when taken along cross-sections of the groove 46, 146 along its length between the leading end 46*a*, 146*a* and the trailing end 46*b*, 146*b*, such that a constant diameter is defined along its length. The workpiece 22 can be accommodated in the groove 46, 146 with minimal clearance between the outer surface of the workpiece 22 and the wall forming the groove 46, 146. The bending shoe 38, 138 may have a single groove 46 for example as shown in FIGS. 1-4, or a plurality of side-by-side grooves 146 for example as shown in FIGS. 9-12, for accommodating workpieces of different sizes therein as is known in the art.

Prior to being bent by the bender 20, 120 and as shown in FIG. 2, the workpiece 22 is elongate and straight, having a front end 22*a* and an opposite rear end 22*b*. A linear workpiece axis 22*c* is defined through the center of the workpiece 22 and between the ends 22*a*, 22*b*. In some embodiments, the workpiece 22 is a piece of conduit. In some embodiments, the workpiece 22 is sheet metal.

Attention is invited to a first embodiment of the bender 20 shown in FIGS. 1-4.

In an embodiment, the driver 28 is a hydraulically driven ram which is actuated by a pump unit having a motor 48 and a pump 50, which provides hydraulic fluid through a hydraulic hose 52 to actuate the driver 28. The driver 28 is mounted to the frame 24 above the bending shoe assembly 26 and mounts the bending shoe assembly 26 to the frame 24. As shown in FIG. 2, the driver 28 includes a hydraulically operated cylinder 54 affixed to the frame 24 and extending vertically therefrom, a piston 56 within the cylinder 54 and operable to extend from the cylinder 54 in a vertically direction when activated, and a yoke 58 fixedly attached to a lower end of the piston 56. The driver 28 provides the rotational force to the bending shoe assembly 26 relative to the frame 24.

Figure 3:
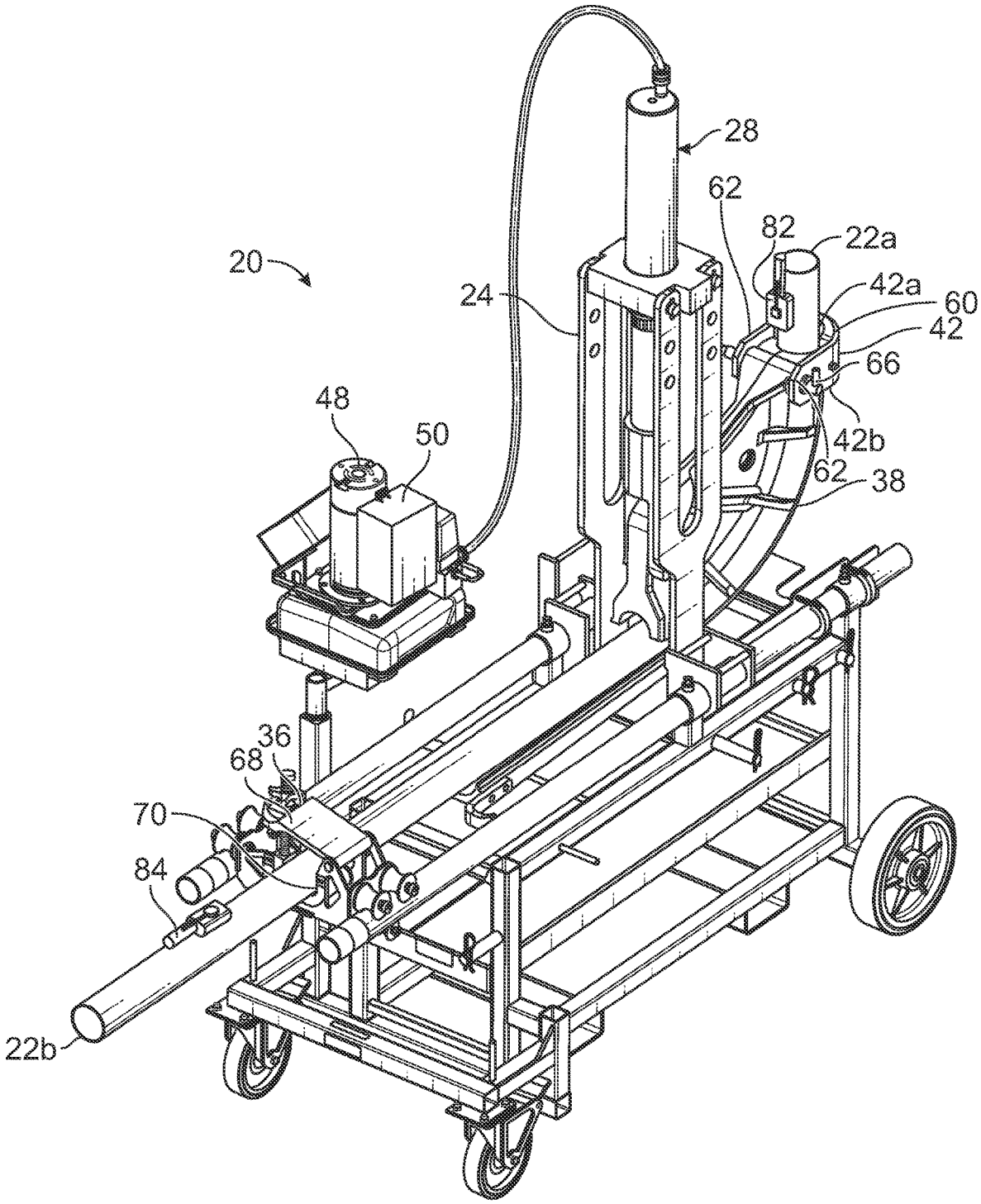
FIG. 3 depicts a perspective view of the bender, and showing the workpiece mounted therein in a bent position.

The gripping member 42 is releasably attached to the body 44 proximate to the leading end 46*a* of the groove 46. As shown in FIG. 3, the gripping member 42 has a leading end 42*a* and an opposite trailing end 42*b*, and includes a base 60 having a pair of arms 62 extending therefrom. The base 60 and the arms 62 define a passageway 64 therethrough in which the workpiece 22 can be seated. The portion of the passageway 64 formed by the base 60 may be semi-circular when taken along cross-sections of the base 60 along its length between the leading and trailing ends 44*a*, 44*b*, such that a constant diameter is defined along its length. The arms 62 extend linearly from opposite side of the base 60. The passageway 64 defined by the base 60 is slightly greater than the outer dimension of the workpiece 22. The distance between the arms 62 is slightly greater than the dimensions of the workpiece 22. The arms 62 are connected to the body 44 at upper ends thereof and extending from opposite sides of the body 44 such that the passageway 64 faces the groove 46 in the bending shoe 38. The gripping member 42 is attached to the body 44 proximate to the leading end 46*a* of the groove 46 by a releasable fastener 66 which extends through the body 44 of the bending shoe 38 and through the arms 62. The workpiece 22 can be seated in the portion of the passageway 64 formed by the base 60 with a predetermined amount of clearance between the outer surface of the workpiece 22 and the groove 46 in the bending shoe 38, and likewise the workpiece 22 can be seated in the groove 46 in the bending shoe 38 with a predetermined amount of clearance between the outer surface of the workpiece 22 and the base 60. The body 44 of the bending shoe 38 engages with the yoke 58 and is attached to the yoke 58 by a releasable fastener. In the embodiment as shown, the workpiece support assembly 36 includes a vise for supporting the rear end 22*b* of the workpiece 22 during the bending operation. The vise has a housing 68 having a passageway 70 therethrough, through which the workpiece 22 extends during the bending operation. The passageway 70 may have a vertical dimension that is larger than the vertical dimension of the workpiece 22 such that the workpiece 22 can move vertically within the housing 68, and/or may have a horizontal dimension that is larger than the horizontal dimension of the workpiece 22 such that the workpiece 22 can move horizontally within the housing 68.

The control system 30 includes a processor 72, a memory 74, and other related components configured to control the operation of the motor 48 to control the driver 28. The control system 30 is in communication with the springback assembly 34 to perform a workpiece bending operation.

The control device 32 includes a processor 76, a memory 78, a user interface 80 and other related components, The control device 32 may be a pendant, a mobile device or other device having a user interface which allows a user to select a bend angle, and displays results of the bending operation to the operator. The control system 30 and the control device 32 may be in wired communication via a hard wire or may be in wireless communication. In an embodiment, the user interface 80 includes a touch screen which allows the operator to input a target bend angle for the bend being performed on the workpiece 22 and a start button which allows the operator to instruct the bender 20 to commence the bending operation. The springback assembly 34 includes a pair of sensors 82, 84 which are in communication with the control system 30. The sensors 82, 84 may be in wireless communication with the control system 30 or may be in wired communication via a hard wire with the control system 30. Each sensor 82, 84 may be an inertial measurement unit, for example an accelerometer or a gyroscope. In an embodiment, each sensor 82, 84 contains an accelerometer to measure the angle that each end 22*a*, 22*b* of the workpiece 22 has rotated in space during the bending process. As is known in the art, accelerometers are configured to measure the component force of gravity on each of its three orthogonal axes. In an embodiment, each sensor 82, 84 contains a gyroscope to measure the angle that each end 22*a*, 22*b* of the workpiece 22 has rotated in space during the bending process. As is known in the art, gyroscopes are configured to measure the angular velocity on each of its three orthogonal axes. If the connection is wireless, the sensors 82, 84 include an energy storage device, such as a battery. If the connection is wired, the wired connection may have wires communicating information from the sensors 82, 84 to the control system 30 and providing power to the sensors 82, 84. For example, the wires may use a USB-C connection.

In use, the workpiece 22 is inserted within the groove 46 between the bending shoe 38 and the gripping member 42, and the gripping member 42 is positioned at the location where the bend starts. The workpiece 22 seats within the base 60 of the gripping member 42 and may partially seats within the groove 46 of the bending shoe 38 in this initial set up. The workpiece 22 is engaged with the workpiece support assembly 36. Thereafter, the sensors 82, 84 are placed on either end 22*a*, 22*b* of the workpiece 22 or to components that rotate with either end of the workpiece 22 such that one sensor 82 is forward of the leading end 46*a* of the bending shoe 38 and the other sensor 84 is rearward of the trailing end 46*b* of the bending shoe 38. Alternatively, the sensors 82, 84 may be placed on the ends 22*a*, 22*b* of the workpiece 22 prior to insertion of the workpiece 22 into the bender 20, however, care must be taken by the operator when inserting the workpiece 22 between the bending shoe 38 and the gripping member 42 so as not to dislodge the sensors 82, 84 from the workpiece 22. Because the workpiece 22 is moving at a relatively slow speed while being bent by the bender 20, it is assumed the outputs of the sensors 82, 84 are not significantly affected by forces other than gravity.

The operator enters a target bend angle, for example a 90° bend angle, into the user interface 80 and activates the bender 20. This may be affected by the operator pressing a "Bend" button on the user interface 80, or a button on the bender 20 which is operatively coupled to the control system 30.

Figure 4:
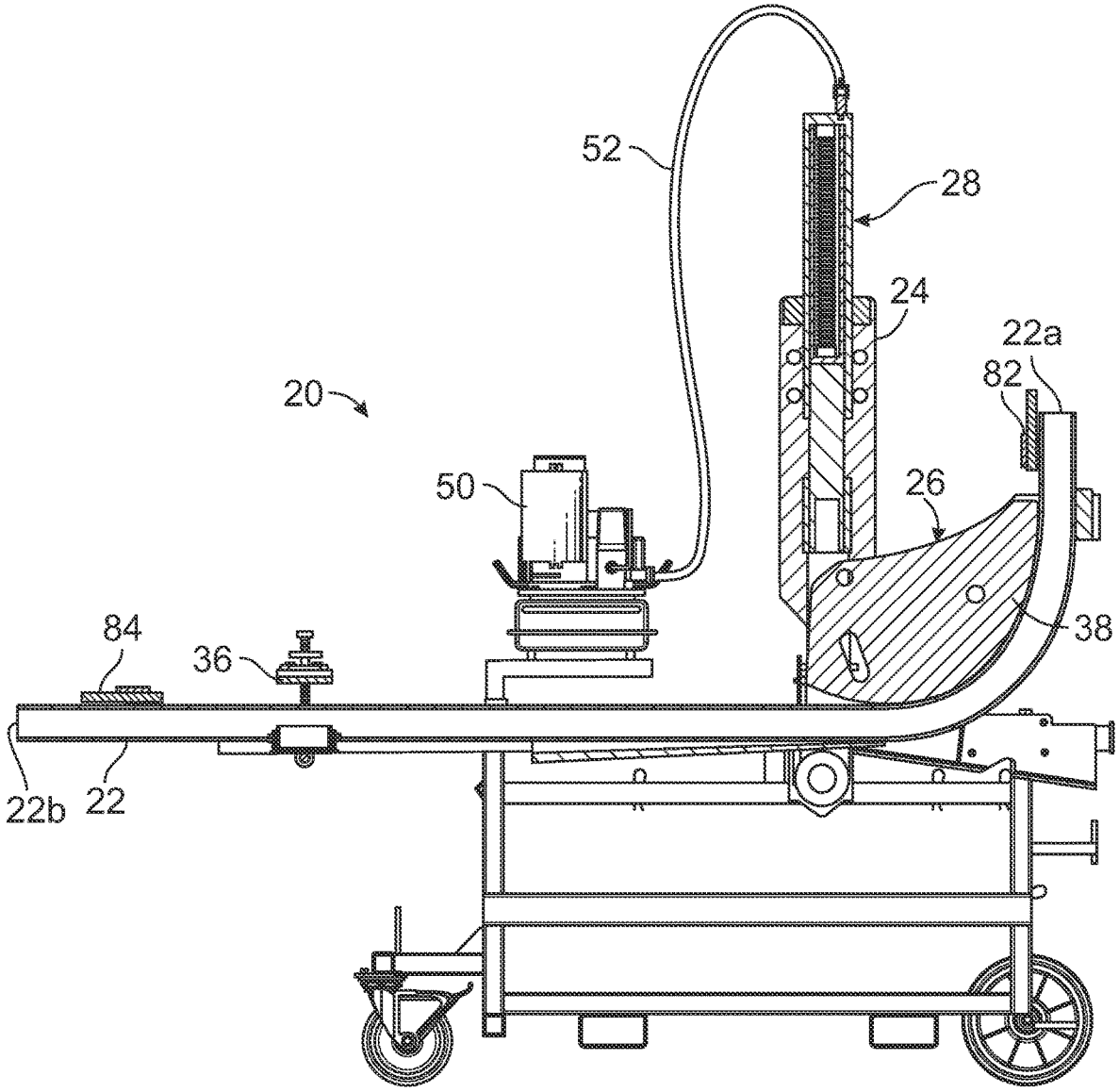
FIG. 4 depicts a cross-sectional view of the bender and the workpiece mounted therein in a bent position.
Figure 5:
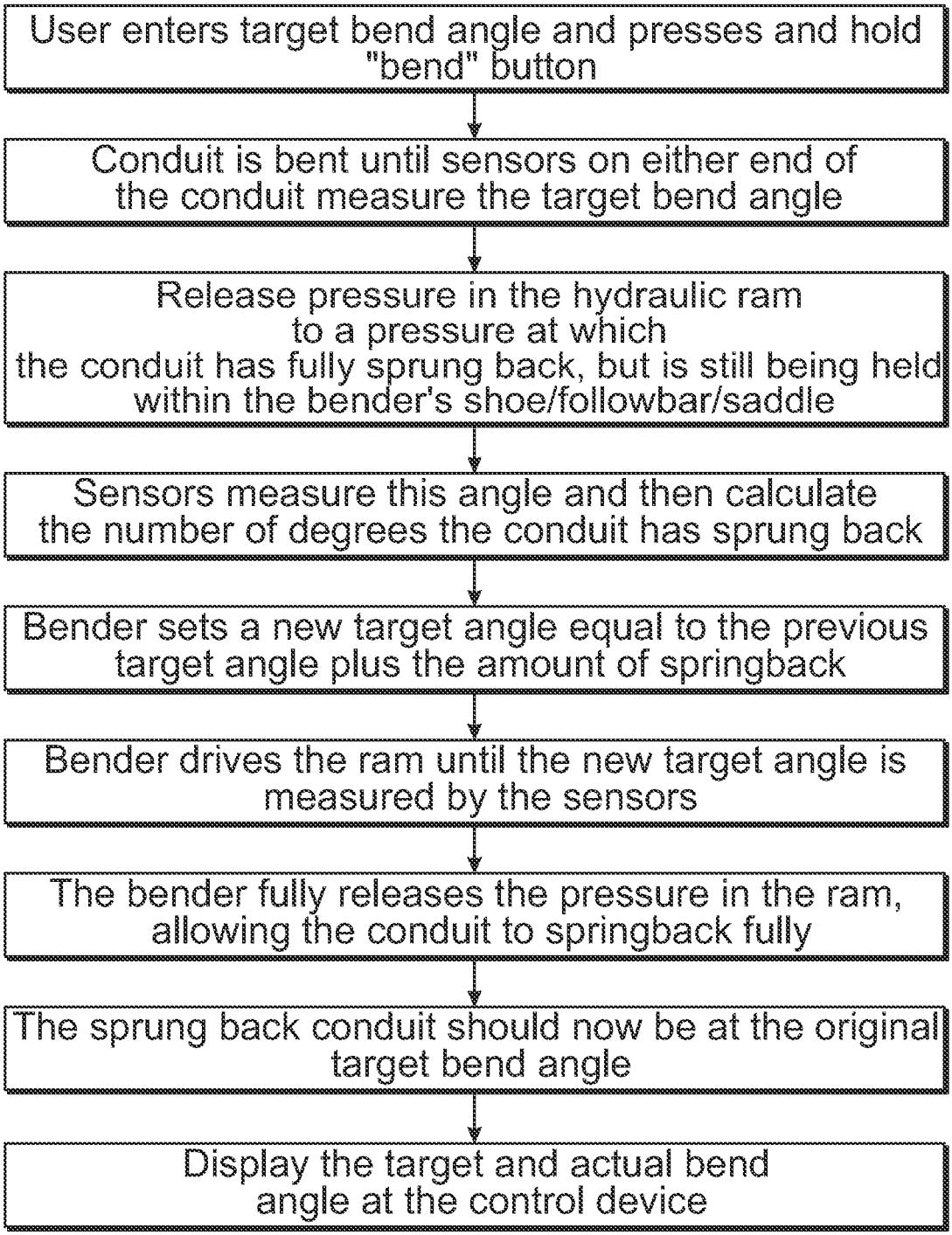
FIG. 5 depicts a flow chart showing a bending operation.
Figure 9:
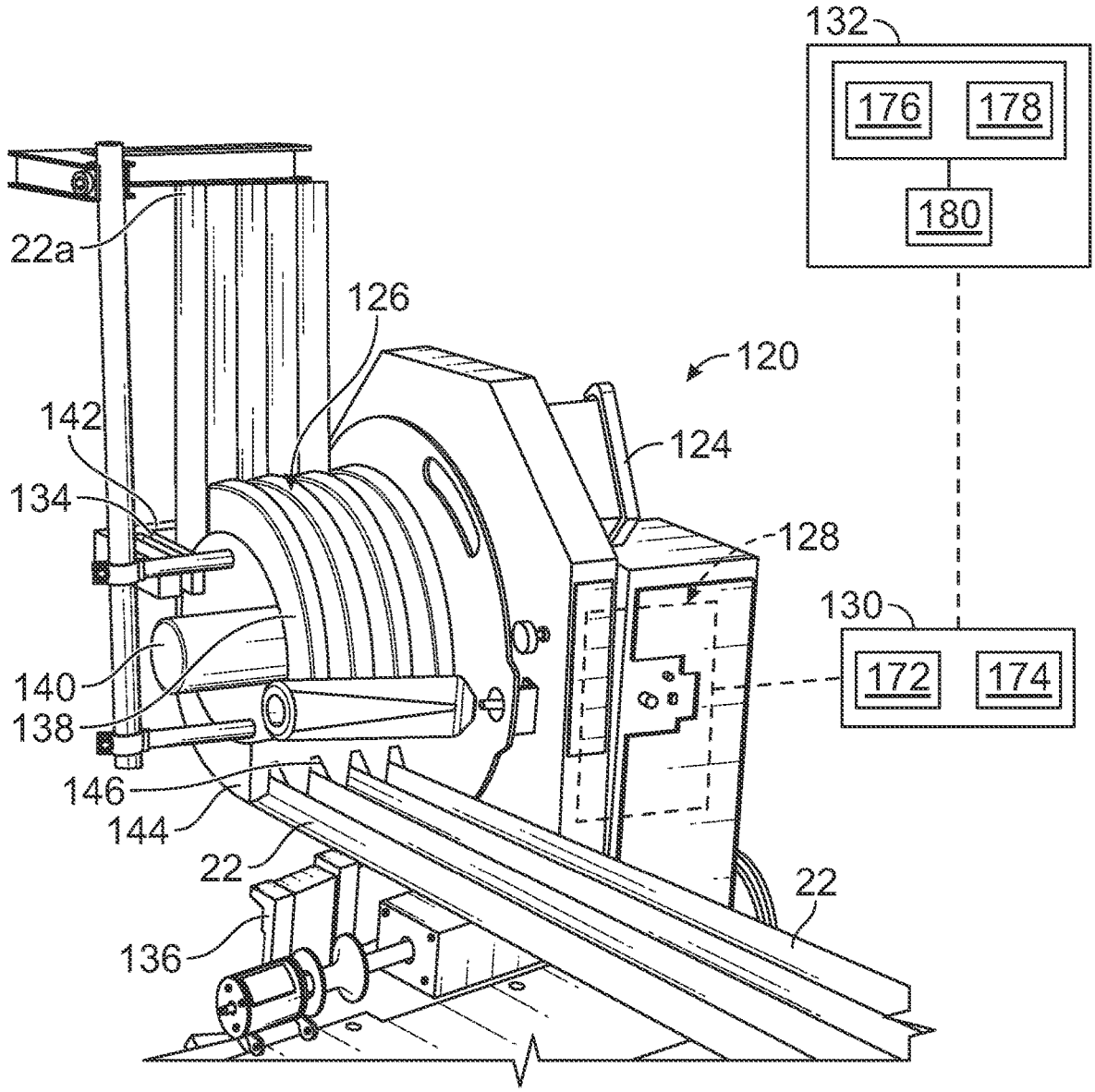
FIG. 9 depicts a perspective view of an alternate example bender which incorporates features of the present disclosure, and showing workpieces mounted therein in bent positions.

Thereafter, the driver 28 is activated under control of the control system 30 to begin the bending operation. Prior to bending, an initial measurement of the position of each sensor 82, 84 along all three axes is sensed by the sensor 82, 84, and sent to the control system 30 and this is the defined herein as the initial position. Activation of the driver 28 causes the application of pressure to the piston 56 and causes the piston 56 and thus the yoke 58 to move vertically downward. This vertical movement causes the bending shoe 38 to rotate relative to the frame 24 and relative to the piston 56, and the gripping member 42 grips the workpiece 22. Upon rotation of the bending shoe 38 with the gripping member 42 gripping the workpiece 22, the workpiece 22 seats within the groove 46 in the bending shoe 38 and wraps the workpiece 22 around the bending shoe 38 such that the portion of the workpiece 22 forward of the leading end 46*a* of the groove 46 of the bending shoe 38 having the sensor 82 thereon is moved from the initial position. During this bending operation, the rear end 22*b* of the workpiece 22 may move. As shown in the orientation of FIG. 4, the bending shoe 38 rotates counter-clockwise to affect the bending operation. The workpiece 22 is moving at a relatively slow speed as the workpiece 22 is being bent by the bender 20.

The control system 30 commands the driver 28 to activate until the sensors 82, 84 measure that the workpiece 22 has been bent to the target bend angle. The sensors 82, 84 actively measure the bend angle of the workpiece 22 during the bending operation and this information is continuously communicated to the control system 30. In this embodiment, since both ends 22*a*, 22*b* of the workpiece 22 may move in all three axes during the bending operation, sensors 82, 84 are required at both ends 22*a*, 22*b* to determine the bend angle of the workpiece 22. In an alternate embodiment, a single sensor 82 is provided at the front end 22*a* of the workpiece 22 and the rear end 22*b* of the workpiece 22 is held on the frame 24 such that the workpiece 22 can only translate longitudinally as the workpiece 22 is bent; the workpiece 22 cannot move laterally or vertically.

Once the control system 30 determines that the target bend angle has been achieved upon receiving information from the sensor(s) 82, 84, the control system 30 commands the driver 28 to stop movement and the control system 30 determines the actual bend angle as described herein. In this disclosure the actual bend angle is assumed not to be the same as the target bend angle at this point. Theoretically, the actual bend angle should be 90°. As an example, the actual bend angle may be 90.3° (alternatively, the actual bend angle may show an undershoot of the target bend angle, for example 89.3°).

The control system 30 then commands that pressure on the driver 28 be released until the pressure reads a predetermined pounds of force per square inch of area, but does not allow a full release of the pressure such that the workpiece 22 is slightly unloaded. This predetermined pounds of force per square inch of area may be for example 100 psi. When the pressure on the driver 28 is partially released, the piston 56 and the yoke 58 travel vertically upward and the bending shoe 38 rotates in the opposite direction (in the clockwise direction as shown in the orientation of FIG. 2). When this occurs, the workpiece 22 partially moves further into the gripping member 42 as the workpiece 22 springs back and away from the groove 46 of the bending shoe 38. The workpiece 22 remains supported by workpiece support assembly 36. This allows the workpiece 22 to fully or almost fully spring back, but to still be held within the groove 46 of the bending shoe 38 and the gripping member 42. As a result, the workpiece 22 is still loaded and does not exit the groove 46 of the bending shoe 38. The control system 30 determines the sprungback bend angle as described herein. This sprungback bend angle may be 88.7°, for example.

In an embodiment, the control system 30 then calculates the difference between the actual bend angle and the sprungback bend angle. This difference is the expected amount of springback of the workpiece 22 (90.3°−88.7°=1.6°). The control system 30 then adds the expected amount of springback (1.6°) of the workpiece 22 to the target bend angle(90°) to calculate a new bend angle (90°+1.6°=91.6°). In another embodiment, the control system 30 then calculates the difference between the target bend angle and the sprungback bend angle. This difference is the expected amount of springback of the workpiece 22 (90.0°−88.7°=1.3°). The control system 30 then adds the expected amount of springback (1.3°) of the workpiece 22 to the target bend angle (90°) to calculate a new bend angle (90°+1.3°=91.3°).

The control system 30 then starts bending the workpiece 22 again until the new bend angle is achieved, that is the workpiece 22 is bent until the sensor(s) 82, 84 measure that the workpiece 22 has been bent to 91.6° or 91.3°. In an embodiment, a factor calculated based on a percentage of the amount of the springback angle can be added to the target bend angle to determine the new bend angle. The driver 28 is activated under control of the control system 30 which causes the application of pressure to the piston 56 and causes the piston 56 and thus the yoke 58 to move vertically downward. This vertical movement causes the bending shoe 38 to rotate relative to the frame 24 and relative to the piston 56, and the gripping member 42 grips the workpiece 22. Upon rotation of the bending shoe 38 with the gripping member 42 gripping the workpiece 22, the workpiece 22 again wraps the workpiece 22 around the bending shoe 38. The driver 28 is activated until the sensor(s) 82, 84 measure that the workpiece 22 has been bent to the new bend angle.

Thereafter, the control system 30 fully releases the pressure from the driver 28 and the workpiece 22 is at the target bend angle or close thereto which will be considered to be the target bend angle. This allows for the release of the workpiece 22 from the bender 20, or allows an operator to position the same workpiece 22 in a new position within the gripping member 42 to allow for a second bend to be affected at a different position along the length of the workpiece 22.

Alternative to the full release at this point, the process above can be repeated until the target bend angle is achieved.

This bender 20 thus provides a closed loop system that automatically drives to the target bend angle of the workpiece 22. This greatly increases the accuracy and thereby reduces waste.

In an embodiment, the control system 30 uses the law of cosines, see FIG. 7, to determine the angle through which each sensor 82, 84 has rotated from the initial position (a) to a second position (b), whereby the second position is the position at any point in time after the bend has started and in embodiments is the actual bend angle and is the sprungback bend angle discussed hereinabove. In FIG. 7, a and b represent three-dimensional vectors comprised of x, y, and z axis sensor readings from the initial position (a), and the current position (b), whereby the current position (b) is the actual bend angle or the sprungback bend angle discussed hereinabove. Angle $\alpha$ represents the angle between the axes. If a single sensor 82 is used, then the control system 30 uses the law of cosines, see FIG. 7, to determine the angle through which the sensor 82 has rotated from the initial position (a) to the second position (b), whereby the second position is the position at any point in time after the bend has started. Those two angles are then added or subtracted by the control system 30, as appropriate, to determine the actual bend angle or the sprungback bend angle as appropriate.

When the workpiece 22 is to have multiple bends, it is desirable for the operator to know if, after the first bend has been completed, that the workpiece 22 is in the proper plane for the second bend. Using measurements from the sensors 82, 84, the operator can see a readout on the user interface 80 of the angle through which the sensors 82, 84 have been rotated around the workpiece axis 22*c* after the first bend. The sensors 82, 84 can calculate the angle through which the workpiece 22 has rotated around the workpiece axis 22*c* following the first bend using either the Law of Cosines described above, or the a tan 2 formula described herein. The sensors 82, 84 convey information to control system 30 regarding the angle at which the workpiece 22 is rotated around the workpiece axis 22*c* at the end of the first bend. As the workpiece 22 is rotated around its workpiece axis 22*c*, this information is displayed on the user interface 80 and monitored by the operator. The workpiece 22 is rotated around the workpiece axis 22*c* by the operator until the operator determines that the workpiece 22 is the proper rotated position for the second bend to be affected in the workpiece 22. When using either the Law of Cosines or the a tan 2 formula to calculate the angle through which the workpiece 22 has rotated around the workpiece axis 22*c* following the first bend, in an embodiment, only the sensor 84 which is attached to the rear end 22*b* of the workpiece 22 is used, since this sensor 84 is aligned with the workpiece axis 22*c* around which the workpiece 22 is rotated when being moved to the second bending position. The a tan 2 formula, see FIG. 8, can be used to determine the angle through which each sensor 82, 84 has rotated from the first position to the second position around the workpiece axis 22*c*. The a tan 2 formula is useful because the rotation of the workpiece 22 always happens around the workpiece axis 22*c* and the mechanical design of the housing of the sensor 84 ensures at least one axis is mostly aligned with the workpiece axis 22*c* and by extension the rotation axis. This a tan 2 formula works assuming that one of the axes of the sensors 82, 84 is aligned with the workpiece axis 22*c* around which the workpiece 22 is being rotated. For example, if the z-axis of the sensors 82, 84 is aligned with the workpiece axis 22*c*, the measurements from the x and y axes of the sensor are used to calculate the rotation angle. In practice, the sensor, for example sensor 84, aligned with the workpiece axis 22*c* around which the workpiece 22 will be rotated by the operator takes a first reference measurement and the control system 30 calculates a rotation angle of the sensor 84 using the a tan 2 formula. This first reference measurement defines a first rotational position of the workpiece 22. As the operator manually rotates the workpiece 22 around the workpiece axis 22*c* to move the workpiece 22 to the second bend position, the sensor 84 continuously take measurements of the rotation of the workpiece 22 around the workpiece axis 22*c*. The control system 30 continuously calculates the rotational position, and this information is output onto the user interface 80 and is monitored by the operator. Most workpieces with multiple bends will require the operator to rotate the workpiece 22 by +90°, −90°, +180° or −180°. Once the desired rotational position is achieved, the operator can clamp the workpiece 22 at that desired position and perform the next bend in the workpiece 22 with confidence that the bending is being done in the proper plane.

The bender 20 thus makes the bending of the workpiece 22 easier for the operator by removing the potential for human error in the measurement process, makes the bending of the workpiece 22 easier for the operator by removing the manual measurement needed to calculate and account for springback in the workpiece 22, and makes the bending of the workpiece 22 faster by introducing an easier way to quickly rotate the workpiece 22 after performing a first bend into a position that allows a second bend to be in the proper plane.

In an embodiment a linear distance sensor (not shown) can be provided on the driver 28 which is in communication with the control system 30. The linear distance sensor is used to measure the distance that the piston 56 travels to determine when the target bend angle is achieved. Information regarding the travel distance of the piston 56 is communicated to the control system 30 and the control system 30 determines the bend angle of the workpiece 22 based upon this information. Thereafter, to account for the springback, the sensors 82, 84 can be used in the manner described above.

Attention is invited to a second embodiment of the bender 120 shown in FIGS. 9-14.

The driver 128 in this embodiment is an electric motor which provides rotational force to the bending shoe assembly 126.

The bending shoe 138 is cantilevered from the frame 124 via the shaft 140. The shaft 140 defines an axis of rotation of the bending shoe 138 relative to the frame 124. The bending shoe 138 and the shaft 140 are rotationally driven by the driver 128 to rotate the bending shoe 138 relative to the frame 124. The groove 146 has an end groove portion 186 extending from its leading end 146*a* which may be semi-circular when taken along cross-sections along its length, such that a constant diameter is defined along the length of the end groove portion 186. A central axis is defined through the end groove portion 186 which is linear.

The gripping member 142 has a first portion 188 attached to the body 144 of the bending shoe 138, and a second portion 190 which is attached to the springback assembly 134. The first portion 188 extends outwardly from the body 144 proximate to the end groove portion 186, and is offset from the end groove portion 186. The first portion 188 may be integrally formed with the body 144 or may be a separate piece which is attached to the body 144.

The springback assembly 134 is attached to an outer end of the first portion 188, extends parallel to the axis of rotation of the bending shoe 138 defined by the shaft 140, and overlaps the end groove portion 186, but is spaced from the bending shoe 138. In an embodiment, the springback assembly 134 is formed from a load cell in communication with the control system 130. The springback assembly 134 may be in wireless communication with the control system 130 or may be in wired communication via a hard wire with the control system 130. If the connection is wireless, the springback assembly 134 include an energy storage device, such as a battery. If the connection is wired, the wired connection may have wires communicating information from the springback assembly 134 to the control system 130 and providing power to the springback assembly 134. For example, the wires may use a USB-C connection.

Figure 13:
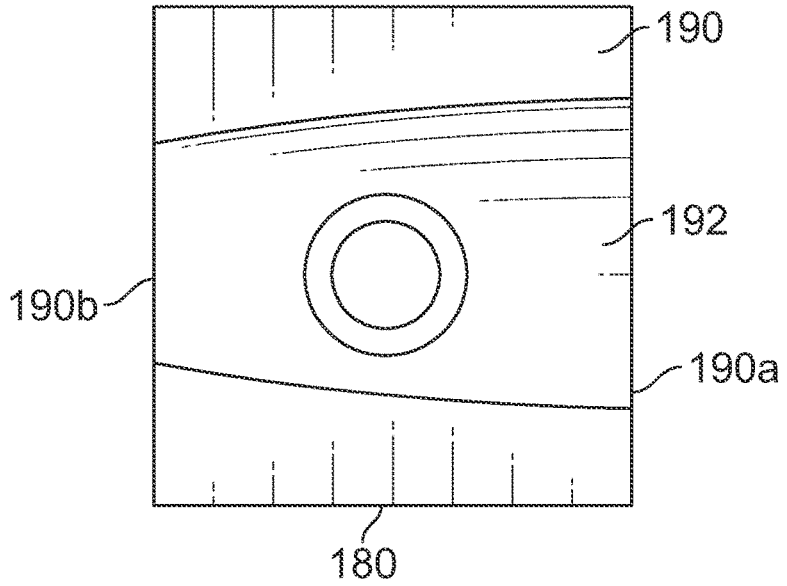
FIG. 13 depicts a cross-sectional view of the gripping member along line 13-13 of FIG. 12.
Figure 14:
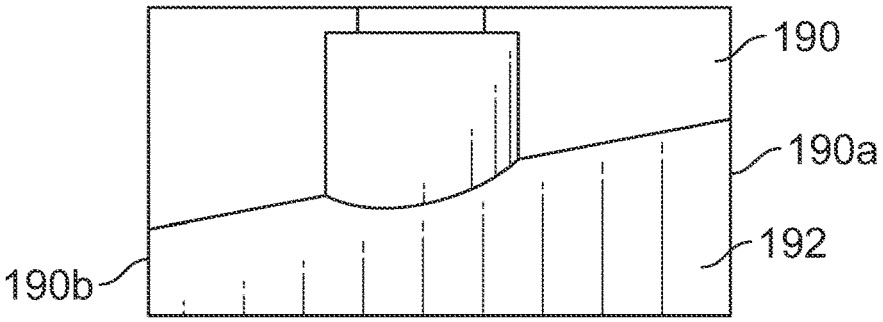
FIG. 14 depicts a cross-sectional view of the gripping member along line 14-14 of FIG. 11.

The second portion 190 of the gripping member 142 has a leading end 190*a* which may align with the leading end 146*a* of the groove 146, and an opposite trailing end 190*b*. A passageway 192 is formed by the second portion 190. The second portion 190 is attached to the springback assembly 134 by an adjustment screw 194, and the passageway 192 faces the end groove portion 186. Since the second portion 190 and the springback assembly 134 are coupled together by the adjustment screw 184, the position of the second portion 190 relative to the springback assembly 134, and also relative to the end groove portion 186, can be adjusted. The passageway 192 is semi-circular when taken along cross-sections of the second portion 190 along its length between the leading and trailing ends 190*a*, 190*b*. The passageway 192 gradually becomes smaller from the leading end 190*a* of the passageway 192 to the trailing end 190*b* of the passageway 192 as shown in FIG. 13, and as shown in FIG. 14, the passageway 192 slopes inwardly from the leading end 190*a* of the passageway 192 to the trailing end 190*b* of the passageway 192. The workpiece 22 is seated in the passageway 192 with the trailing end 190*b* bearing against the wall of the workpiece 22.

As a result, the first portion 188, the springback assembly 134 and the second portion 190 form a hook that is rigidly attached to the bending shoe 138.

In the embodiment as shown, the workpiece support assembly 136 includes at least one roller on which the workpiece 22 is supported during bending.

The control system 130 includes a processor 172, a memory 174, and other related components configured to control the operation of the driver 128. The control system 130 is in communication with the springback assembly 34 to perform a workpiece bending operation.

The control device 132 includes a processor 176, a memory 178, a user interface 180 and other related components, The control device 132 may be a pendant, a mobile device or other device having a user interface which allows a user to select a bend angle, and displays results of the bending operation to the operator. The control system 130 and the control device 132 may be in wired communication via a hard wire or may be in wireless communication. In an embodiment, the user interface 180 includes a touch screen which allows the operator to input a target bend angle for the bend being performed on the workpiece 22 and a start button which allows the operator to instruct the bender 120 to commence the bending operation.

In use, the workpiece 22 is inserted within the groove 146 and between the end groove portion 186 and the second portion 190 of the gripping member 142. The second portion 190 is moved toward the workpiece 22 by adjustment of the adjustment screw 184 until the trailing end 190*b* of the second portion 190 engages the workpiece 22. The workpiece 22 may not engage with the workpiece support assembly 136 in this initial set up.

The operator enters a target bend angle, for example a 90° bend angle, into the user interface 180 and activates the bender 120. This may be affected by the operator pressing a "Bend" button on the user interface 180, or a button on the bender 120 which is operatively coupled to the control system 130.

Figure 11:
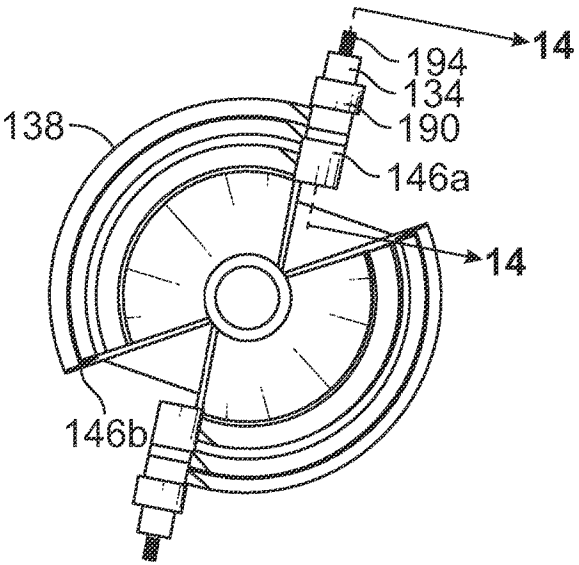
FIG. 11 depicts a side elevation view of the bending shoe and gripping member of FIG. 10.

Thereafter, the driver 128 is activated under control of the control system 130 to begin the bending operation. Activation of the driver 128 causes the rotation of the shaft 140 and the bending shoe 138 relative to the frame 124, and the second portion 190 of the gripping member 142 grips the workpiece 22. Upon rotation of the bending shoe 138 with the gripping member 142 gripping the workpiece 22, the workpiece 22 seats within the groove 146 in the bending shoe 138 and wraps the workpiece 22 around the bending shoe 138 such that the front end 22*a* of the workpiece 22 is raised from the horizontal position. During this bending operation, the rear end 22*b* of the workpiece 22 may move during the bending operation. As shown in the orientation of FIG. 11, the bending shoe 138 rotates clockwise to affect the bending operation. The workpiece 22 is moving at a relatively slow speed as the workpiece 22 is being bent by the bender 120.

The control system 130 commands the driver 128 to activate until the target bend angle or a bend angle just past the target bend angle is reached. To monitor this, the shaft 140 may have a rotary encoder in communication with the control system 130 provided thereon which indicates when the shaft 140 has rotated the necessary amount. Because the workpiece 22 pushes against the second portion 190 as result of the springback of the workpiece 22, and because the second portion 190 is rigidly connected to the bending shoe 138, the workpiece 22 tries to force the bending shoe 138 to rotate backward in the "unloading" direction. Once the control system 130 determines that the target bend angle has been reached or a bend angle just past the target bend angle has been reached, the control system 130 commands the driver 128 to stop movement. This is the actual bend angle at this point. A first reference measurement of force from the springback assembly 134 is taken and conveyed to the control system 130.

The control system 130 then commands that the driver 128 rotate a predetermined amount of degrees in the opposite direction (in the counter-clockwise direction as shown in the orientation of FIG. 11), for example approximately 0.5 degrees, which causes the shaft 140 and the bending shoe 138 to rotate in in the opposite direction which allows the workpiece 22 to partially spring back, but does not allow the workpiece 22 to fully spring back. The workpiece 22 is still held within the groove 146 of the bending shoe 138 and the gripping member 142. As a result, the workpiece 22 is still loaded and does not fully exit the groove 146 of the bending shoe 138. Once rotation in the reverse direction is stopped under control of the control system 130, the control system 130 determines a second reference measurement of force based upon the information received from the springback assembly 134. As an example, this second reference measurement of force may be 2500 pounds.

Figure 15:
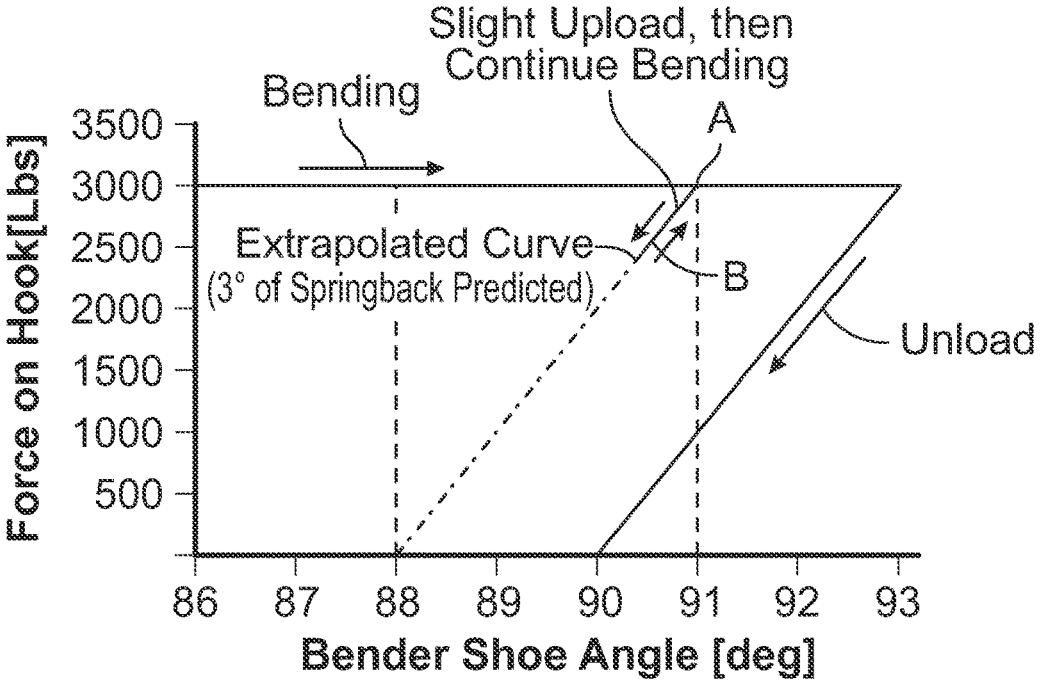
FIG. 15 depicts a chart showing a process of determining the springback angle.
Figure 16:
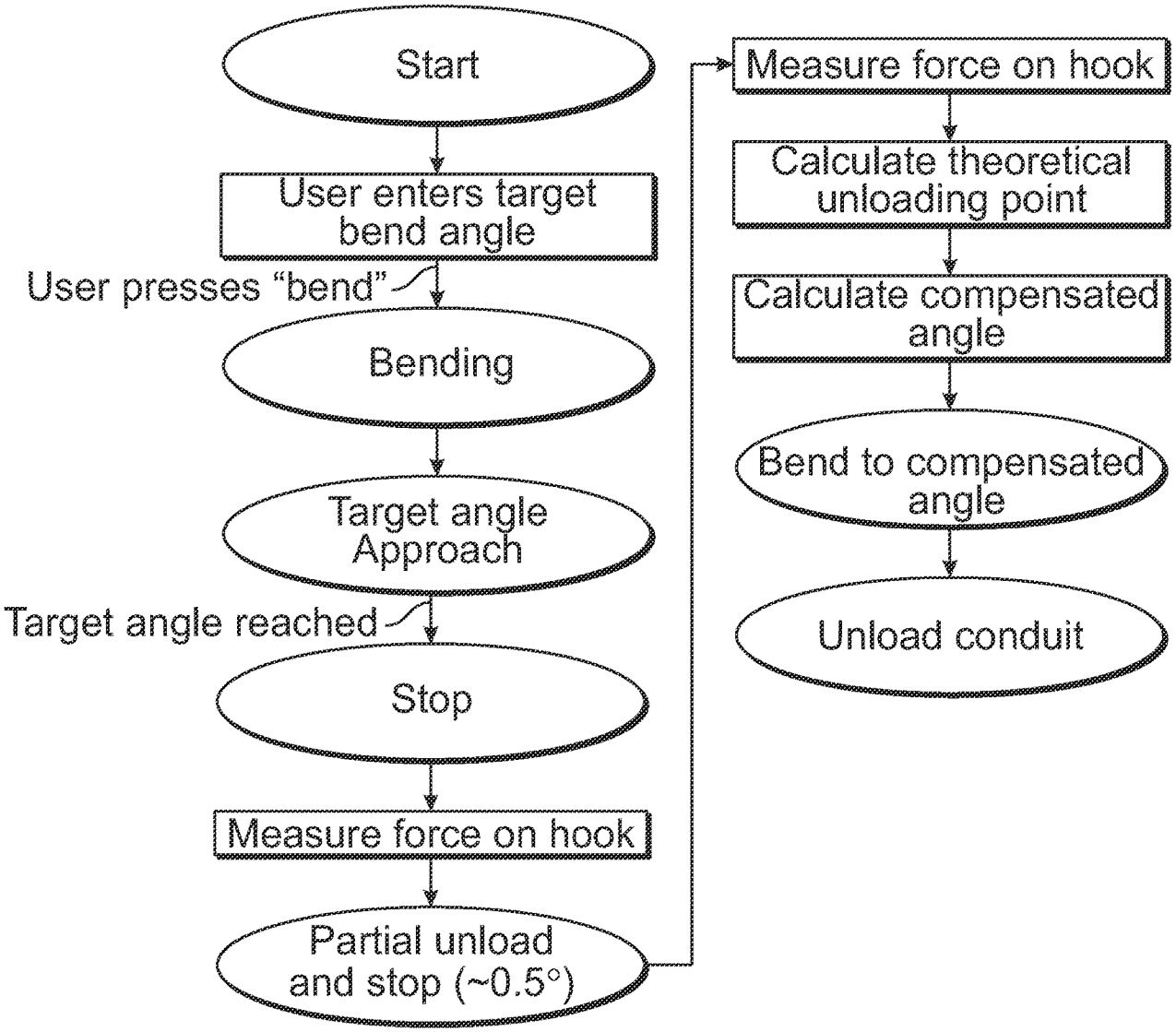
FIG. 16 depicts a flowchart showing a process of bending the workpiece.

A theoretical unloading point of the workpiece 22 and a compensated angle/new bend angle to which the workpiece 22 is to be bent is then determined. When the workpiece 22 is slightly unloaded by the reverse rotation by the known amount of degrees, the control system 130 measures how the force on the second portion decreases as measured by the springback assembly 134. This is shown at point B in FIG. 15. The control system 130 uses that data to extrapolate how many more degrees of unloading are required to fully unload the workpiece 22. This determines the springback angle without fully unloading the workpiece 22. This process is shown in the chart of FIG. 15. As an example, the workpiece 22 is to be bent to a target 90° bend angle. As shown in the example of FIG. 15, the workpiece 22 is bent just past the target 90° bend angle (in some embodiments the workpiece 22 is bent to the target bend angle), and as shown at point A, the workpiece 22 has been bent to a 91° bend angle. The force on the gripping member 142 is measured by the springback assembly 134, 3000 pounds, and this information is conveyed to the control system 130. The workpiece 22 is then unloaded by reversing the rotation of the bending shoe 138 and gripping member 142 such the workpiece 22 is allowed to partially springback to a 90.5° bend angle, which in this example is 0.5° of unloading. The force on the gripping member 142 is then measured by the springback assembly 134, 2500 pounds, which drops as a result of the springback of the workpiece 22. The control system 130 then extrapolates that the workpiece 22 will actually springback a total of 3° if the workpiece 22 was fully unloaded. This represents the theoretical unloading point of the workpiece 22 and provides the extrapolated springback angle. The workpiece 22 cannot be fully unloaded as this may result in the workpiece 22 moving out of the groove 146 in the bending shoe 138. Thereafter, the compensated angle/new bend angle is calculated to be a 93° bend angle (the target angle (90°) plus the extrapolated springback angle (3°)) and the workpiece 22 is bent to the 93° bend angle.

The control system 130 then starts bending the workpiece 22 again until the compensated angle/new bend angle is achieved. The driver 128 is activated under control of the control system 130 which causes the shaft 140 and the bending shoe 138 to rotate relative to the frame 124. Upon rotation of the bending shoe 138 with the gripping member 142 gripping the workpiece 22, the workpiece 22 again wraps the workpiece 22 around the bending shoe 138. The driver 128 is activated until the bending shoe 138 has been rotated to the compensated angle/new bend angle (calculated from the original starting position of the workpiece 22).

Thereafter, the control system 130 commands the driver 128 to stop rotation and the workpiece 22 is at the target bend angle. Thereafter, the control system 130 commands that the driver 128 rotate a predetermined amount of degrees in the opposite direction to reverse the rotation of the bending shoe 138, which allows for the release of the workpiece 22 from the bender 120, or allows an operator to position the same workpiece 22 in a new position within the gripping member 142 to allow for a second bend to be affected at a different position along the length of the workpiece 22.

Alternative to the full release, the process can be repeated if the target angle has not been reached.

This bender 120 thus provides a closed loop system that automatically drives to the target bend angle of the workpiece 22. This greatly increases the accuracy and thereby reduces waste.

While the above describes the use of the springback assembly 134 on the bending shoe 138 to take the measurements, the measurements can be taken anywhere along the drivetrain of the driver 128, provided the measured value (force, current, mechanical strain, etc.) can be correlated to the torque required to hold the end of the workpiece 22 from springing back. and used by the control system 130 as described above.

Figure 17:
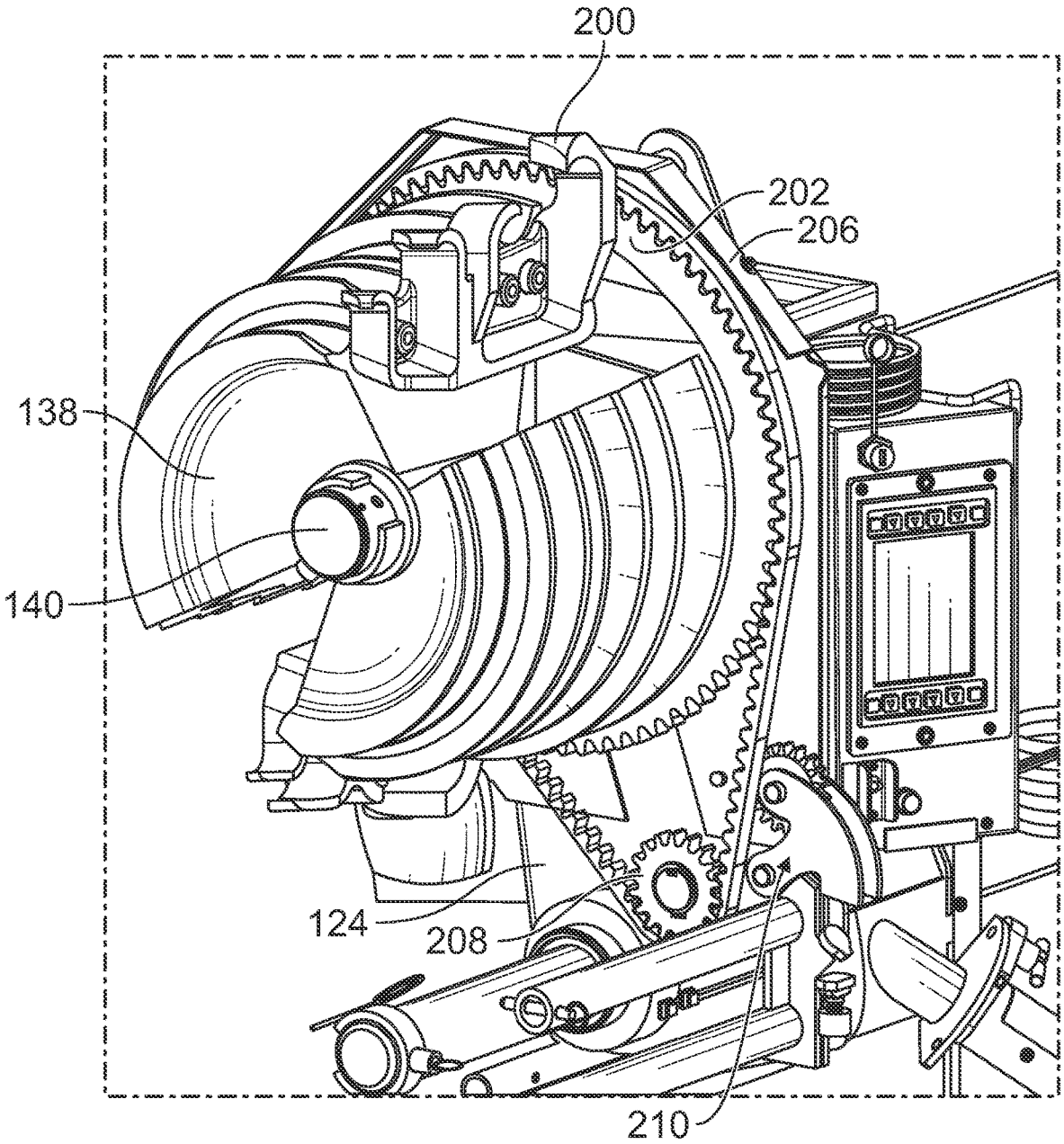
FIG. 17 depicts a perspective view of an example bender which incorporates features of the present disclosure.

A first alternative embodiment to the springback assembly 134 provided as a load cell on the second portion 190 as shown in FIG. 17. A traditional hook 200 extends from the bending shoe 138 and grasps the end 22*a* of the workpiece 22 during the bending operation as it known in the art. A sprocket 202 is mounted on the shaft 140 of the bending shoe 138. The bending shoe 138 mates with the sprocket 202 by pegs 204 (see FIG. 18) that are affixed to the bending shoe 138, and extend through clearance holes in the sprocket 202. The sprocket 202 has a chain 206 therearound which mates with another sprocket 208 which is rotatably mounted on the frame 124. When the driver 128 rotates the bending shoe 138, the sprocket 202 is also rotated via the engagement of the sprocket 202 with the pegs 204. Because the hook 200 is rigidly connected to the bending shoe 138, and the bending shoe 138 in turn is connected to the sprocket 202, and the sprocket 202 to the chain 206, the tension in the chain 206 can be measured as a proxy for the force on the gripping member 142 as disclosed in the embodiment of FIG. 17. To measure the tension in the chain 206, the force necessary to deflect the chain 206 by a known distance is measured by a tension measurement device 210 which is in communication with the control system 130. This control system 130 uses the force value to calculate the tension in the chain 206. An example of a suitable tension measurement device 210 is disclosed in U.S. Pat. No. 10,345,170, which is commonly owned by the assignee of the present application. U.S. Pat. No. 10,345,170 discloses a tension measurement device 210 which has a load cell therein; when used with the present disclosure, the chain 206 would be routed through the tension measurement device 210. Other tension measurement devices 210 are within the scope of the present disclosure.

Figure 18:
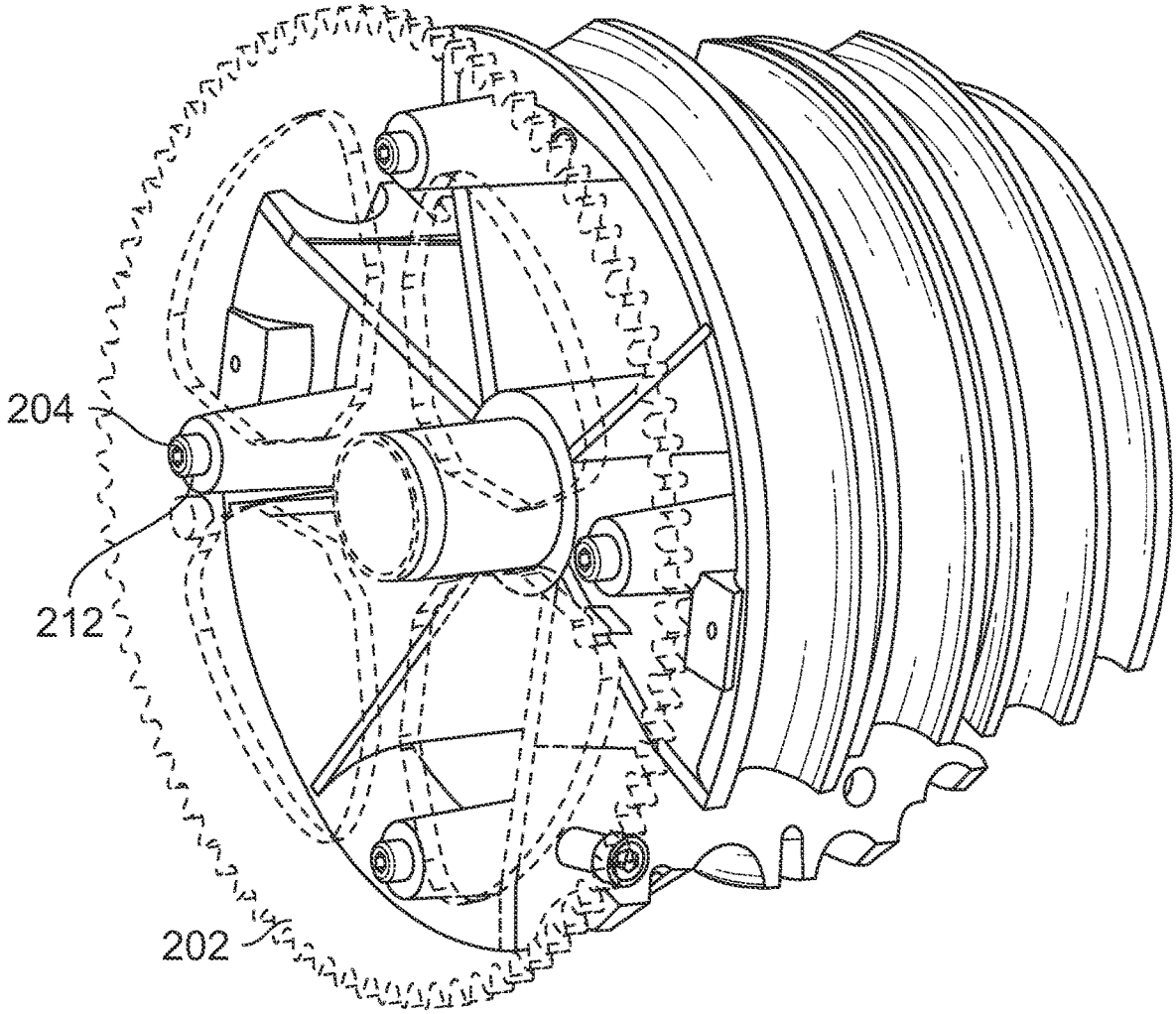
FIG. 18 depicts a bending shoe which incorporates features of the present disclosure.

In a second alternative embodiment to the springback assembly 134 provided as a load cell on the second portion 190, an amount of torque on the bending shoe 138 can be measured and used by the control system 130 to calculate the theoretical unloading point of the workpiece 22 and to calculate the compensated angle/new bend angle to which the workpiece 22 is to be bent. As shown in the embodiment of FIG. 18, a radial load cell 212 is placed around one or more of the clearance holes in the sprocket 202. As described above, when the driver 128 rotates the bending shoe 138, the sprocket 202 is also rotated via the engagement of the sprocket 202 with the pegs 204. The tangential force (torque) that the sprocket 202 exerts on the bending shoe 138 is measured by the radial load cell 212 as the peg 204 engages the radial load cell 212, and this information is continuously conveyed to the control system 130 to calculate the theoretical unloading point of the workpiece 22 and to calculate the compensated angle/new bend angle to which the workpiece 22 is to be bent.

In a third alternative embodiment to the springback assembly 134 provided as a load cell on the second portion 190, the electrical current being drawn by the driver 128 can be measured and used by the control system 130 to calculate the theoretical unloading point of the workpiece 22 and to calculate the compensated angle/new bend angle to which the workpiece 22 is to be bent. In this embodiment, the drivetrain of the driver 128 allows the driver 128 to be "backdriven" (the driver 128 can be physically rotated backward by a force applied to the bending shoe 138). The driver 128 has structure which constantly resists the springback of the workpiece 22, even when the bending operation is paused. The control system 130 measures the current draw of the driver 128 before and after the backdriving (which is only a slight backdrive) and calculates the theoretical unloading point of the workpiece 22 which is used to calculate the compensated angle/second pressurized bend angle to which the workpiece 22 is to be bent.

In a fourth alternative embodiment to the springback assembly 134 provided as a load cell on the second portion 190, the force exerted on the rollers in the workpiece support assembly 136 by the other end of the workpiece 22 can be used to calculate the theoretical unloading point of the workpiece 22.

These alternative embodiments provide examples of other means that can be used to measure values that have a direct relationship with the force of the workpiece 22 on the hook (that is, this "other value" would be used as a proxy for the force on the hook).

Use of the bender 20, 120 of the present disclosure results in bent workpiece 22 having accurate bend angles, which makes assembly in an end project easier for the operator. Use of the bender 20, 120 of the present disclosure also provides for faster bending operations since the operator does not have to check each bend in the workpiece 22 after it is made, and does not have to check the bend amount by hand. This results in less scrap material, which allows the company to buy less material, since the workpiece 22 is consistently and automatically bent to the target angle.

Many modifications and other embodiments of the disclosure set forth herein will come to mind to one skilled in the art to which these disclosed embodiments pertain having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the disclosure. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A method of operating a bender to bend a workpiece to a desired target bend angle in a bending operation, the method comprising:

sensing an initial position of a workpiece positioned within a groove of a bending shoe and gripped by a gripping member;

bending the workpiece to only the desired target bend angle in an initial bending around a bending shoe by rotating the bending shoe in a first direction and sensing the bend angles of the workpiece during the initial bending;

stopping the rotation of the bending shoe in the first direction when the desired target bend angle is sensed;

thereafter determining an actual bend angle of the workpiece;

thereafter rotating the bending shoe and gripping member in a second direction which is opposite to the first direction thereby allowing the workpiece to springback, wherein the workpiece is continued to be gripped by the gripping member during rotation in the second direction;

stopping the rotation of the bending shoe in the second direction such that a new position of the workpiece is provided;

thereafter sensing information regarding the new position of the workpiece and determining a sprungback bend angle at which the workpiece is bent;

calculating a new bend angle at which the workpiece is to be bent to achieve the desired target bend angle, wherein the new bend angle is calculated based upon the sprungback bend angle and one of the actual bend angle and the first desired target bend angle;

thereafter bending the workpiece to the new bend angle around the bending shoe by rotating the bending shoe and gripping member in the first direction with the workpiece being continued to be gripped by the gripping member and sensing the bend angles of the workpiece during the bending of the workpiece to the new bend angle; and stopping the rotation of the bending shoe in the first direction when the new bend angle is sensed.

2. The method of claim 1, further comprising mounting a sensor on the workpiece forward of a leading edge of the bending shoe, and wherein the bend angles are sensed by using the sensor, wherein the sensor moves with the workpiece during the bending operation.

3. The method of claim 2, wherein the sensor is comprised of one of an accelerometer and a gyroscope.

4. The method of claim 1, wherein the new bend angle is calculated by calculating a difference between the sprungback bend angle and one of the actual bend angle and the desired target bend angle to provide an expected amount of springback, and thereafter adding the expected amount of springback and the first desired target bend angle.

5. The method claim 4, further comprising adding a factor calculated based on a percentage of the amount of the sprungback bend angle.

6. The method of claim 1, wherein after the rotation of the bending shoe is stopped when the new bend angle is reached, further comprising:

rotating the bending shoe in the second direction;

rotating the workpiece around a workpiece axis; and sensing a rotational position of the workpiece as the workpiece is rotating around the workpiece axis.

7. The method of claim 6, further comprising displaying the rotational position of the workpiece on a display as the workpiece is being rotated around the workpiece axis.

8. The method of claim 7, further comprising translating the workpiece to a desired position along the workpiece axis.

9. The method of claim 8, wherein the rotating of the workpiece is rotated until the workpiece is rotated to a proper rotated position for a second bend, and thereafter bending the workpiece around the bending shoe by rotating the bending shoe in the first direction to make the second bend in the workpiece.

10. The method of claim 9, wherein a first sensor and a second sensor are used for sensing the bending angles and at least one of the first and second sensors senses the proper rotated position around the workpiece axis, wherein the first and second sensors are one of an accelerometer and a gyroscope mounted to the workpiece.

11. The method of claim 1, wherein the bend angles are sensed by using a load cell.

12. The method of claim 1, wherein the rotation of the bending shoe in the first direction is effected by actuation of one of an electric motor and a hydraulically actuated ram.

13. The method of claim 1, further comprising mounting a first sensor on the workpiece forward of a leading edge of the bending shoe and mounting a second sensor on the workpiece rearward of a trailing edge of the bending shoe, wherein the bend angles are sensed by using the first and second sensors and the first and second sensors move with the workpiece during the bending operation.

14. The method of claim 13, wherein each sensor is one of an accelerometer and a gyroscope.

15. The method of claim 1, further comprising mounting a first sensor on the workpiece and mounting a second sensor on the workpiece; and engaging the workpiece with the groove of a bending shoe and the workpiece with the gripping member, wherein the first sensor is forward of a leading edge of the bending shoe and the second sensor is rearward of a trailing edge of the bending shoe, wherein the bend angles are sensed by using the first and second sensors and the first and second sensors move with the workpiece during the bending operation.

16. The method of claim 15, wherein each sensor is one of an accelerometer and a gyroscope.

17. The method of claim 1, wherein the bending shoe is rotated in the first direction under action of a hydraulic ram, and wherein the bending shoe is rotated in the second direction when pressure on the hydraulic ram is relieved.

18. The method of claim 17, wherein the rotation of the bending shoe in the second direction is stopped when a target pressure is reached.

19. The method of claim 1, further comprising releasing the workpiece from the bending shoe and gripping member;

thereafter sensing a bend angle at which the workpiece is bent to determine a final bend angle; and comparing the final bend angle to the desired bend angle.

20. The method of claim 1, wherein the bending shoe and gripping member are rotated in the second direction by a predetermined amount of degrees to partially unload the workpiece, and wherein the sprungback bend angle is determined by calculating a theoretical unloading point of the workpiece and extrapolating a required amount of degrees of rotation to fully unload the workpiece.

* * * * *